US005630568A

United States Patent [19]

Lubrecht

[11] Patent Number: 5,630,568

[45] Date of Patent: May 20, 1997

[54] METHOD AND APPARATUS FOR SUPPORTING AN ARCHERY BOW FROM A SURFACE

[75] Inventor: Edward Lubrecht, Edgewood, Ky.

[73] Assignee: Advanced Hunting Equipment, L.L.C., Edgewood, Ky.

[21] Appl. No.: 394,411

[22] Filed: Feb. 24, 1995

[51] Int. Cl.[6] ..... A47F 5/00

[52] U.S. Cl. ..... 248/217.4; 248/216.1; 248/314; 248/538; 124/1; 124/23.1; 124/89

[58] Field of Search ..... 248/216.1, 217.4, 248/314, 530, 534, 538, 540, 541; 124/1, 80, 88, 89, 23.1

[56] References Cited

U.S. PATENT DOCUMENTS

| | | | |
|---|---|---|---|
| 1,737,151 | 11/1929 | Derbyshire | 248/541 |
| 2,126,457 | 4/1938 | East | 248/538 |
| 2,169,965 | 8/1939 | Niedermaier | 248/217.4 X |
| 2,482,241 | 1/1949 | Oglesby | 248/217.4 X |
| 2,619,308 | 11/1952 | Guestinger | 248/518 |
| 2,931,603 | 4/1960 | Johnston et al. | 248/217.4 X |
| 3,920,207 | 11/1975 | Adamaitis | 248/538 |
| 4,135,486 | 1/1979 | Enomoto | 124/89 |
| 4,360,179 | 11/1982 | Roberts | 248/126 |
| 4,474,296 | 10/1984 | Hartman | 211/13 |
| 4,633,846 | 1/1987 | Ipock | 124/80 X |
| 4,886,228 | 12/1989 | Kennedy | 248/216.1 X |
| 4,907,567 | 3/1990 | Henrich | 124/89 |
| 4,957,095 | 9/1990 | Cameron | 124/89 |
| 5,076,522 | 12/1991 | Stinson | 248/216.1 |
| 5,098,057 | 3/1992 | Gran et al. | 248/530 |
| 5,106,044 | 4/1992 | Regard, III et al. | 248/169 |
| 5,310,150 | 5/1994 | Fecko | 248/218.2 |

*Primary Examiner*—Ramon O. Ramirez
*Assistant Examiner*—Brian J. Hamilla
*Attorney, Agent, or Firm*—Wood, Herron & Evans, L.L.P.

[57] ABSTRACT

An archery bow holder for holding an archery bow in a desired position and orientation by supporting an archery bow counterweight from a surface. The archery bow holder comprises a bow counterweight support and a threaded shaft extending therefrom. The threaded shaft is twisted into the surface; and the bow counterweight is inserted into the bow counterweight support, thereby supporting the archery bow from the surface.

12 Claims, 1 Drawing Sheet

METHOD AND APPARATUS FOR SUPPORTING AN ARCHERY BOW FROM A SURFACE

FIELD OF THE INVENTION

The present invention relates generally to a method and apparatus for holding and supporting an archery bow from a tree trunk, tree limb, fence post or other surface. More particularly, the invention provides a method and apparatus for hanging or supporting the bow by holding the bow counterweight.

BACKGROUND OF THE INVENTION

When hunting with archery bows it is desirable that the bow be able to be properly held and supported off of the body of the hunter. Further, many contemporary archery bows contain sophisticated sighting equipment and tuned counterweights which make it desirable that the bow not be laid on the ground, dropped, or otherwise subjected to physical shocks. Further, laying a bow on the ground subjects it to unnecessary moisture, dirt, etc. which adversely affects the sights, counterweights, and the structure of the bow itself.

Devices are known for hanging an archery bow from a surface in a generally upright, that is vertical, position. For example, the Fecko U.S. Pat. No. 5,310,150 discloses a bow hanger which is a long rod that has a threaded end screwed into a tree and a hook on the opposite end from which the bow is hung. While the hanger disclosed in the '150 patent is capable of suspending the bow in the ready position, it has the disadvantage of requiring a relatively complex looped motion to unhook the bow from the hanger. The hanger has a further disadvantage of being relatively large and is difficult to pack and carry. Other devices are known which rest on the ground or other horizontal surface and support the bow in a generally upright position, for example, see U.S. Pat. Nos. 5,106,044, 4,474,296, 4,360, 179. While all of the above devices work reasonably well, they have the disadvantages of first, not being designed for use off of the ground. Further, such devices do not present the bow to the hunter in the optimum position ready for shooting. In addition, such devices are often relatively large and may be awkward and difficult to carry, set up, break down, and pack with the other equipment.

SUMMARY OF THE INVENTION

To overcome the disadvantages described above, the present invention provides an archery bow holder which is compact, lightweight, and easy to attach to a surface from which the bow is to be hung or supported. In addition, the archery bow holder of the present invention may be mounted at any elevation that is convenient to the location of the hunter. Further, the present invention provides an archery bow holder that presents the bow to the hunter in an optimal position ready for shooting. Therefore, the archery bow holder of the present invention is also useful when the hunter is stationed in a tree or other elevation off the ground.

According to the principles of the present invention and in accordance with the described embodiments, the present invention provides an archery bow holder which supports or holds an archery bow counterweight and its associated archery bow from a surface. The archery bow holder has a generally tubular body with an internal bore shaped to receive the archery bow counterweight. A connecting element has one end connected to the tubular body and an opposite end shaped to engage and penetrate the surface from which the archery bow is to be supported. Therefore, when the archery bow counterweight is inserted in the internal bore of the tubular body, the archery bow counterweight and its associated archery bow are held or supported from the desired surface.

In a further embodiment, the invention provides a method of holding an archery bow from a surface by screwing a connector of a bow counterweight holder into the surface. The method further includes the step of inserting the bow counterweight into an internal cavity of the bow counterweight holder thereby supporting the archery bow counterweight and the archery bow from the desired surface. An archery bow held by its counterweight can be located at the optimum position for the hunter with an arrow supported in the bow and ready for immediate use. The bow holder of the present invention permits the bow to be easily and quickly removed from the holder and the arrow released without any interference with the bow holder.

These and other objects and advantages of the present invention will become more readily apparent during the following detailed description in conjunction with the drawings herein.

DETAILED DESCRIPTION OF THE INVENTION

Figure 1:
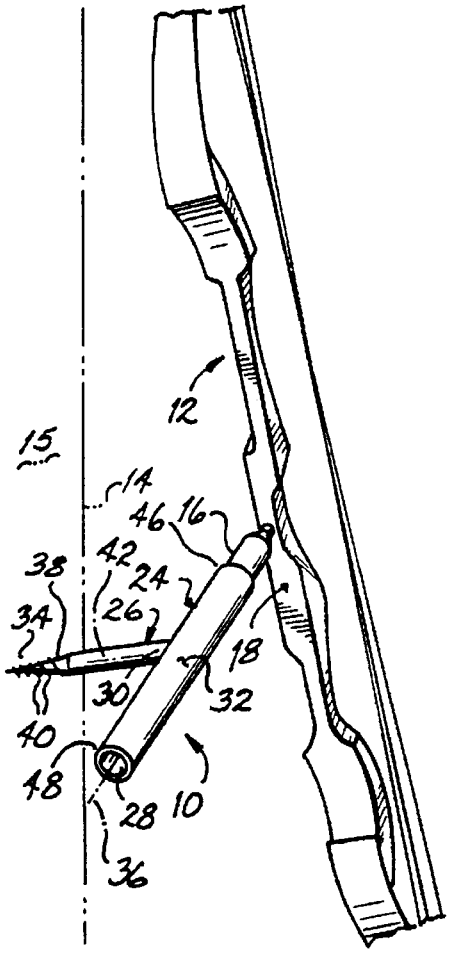
FIG. 1 is a perspective view of an archery bow holder embodying the principles of the present invention.

Referring to FIG. 1, the archery bow holder 10 is shown holding an archery bow 12 from a desired surface 14. The desired surface 14 may be a surface of a tree trunk, a tree limb, a fence post, or other object 15 which the archery bow holder 10 can penetrate or be otherwise attached thereto. The archery bow 12 has an archery bow counterweight 16 extending outwardly from a forward side 18 of the bow 12. The archery bow holder 10 is generally T-shaped and is comprised of a bow counterweight support 24 and a connecting element 26 extending therefrom. The connecting element 26 is inserted through the desired surface 14 and into the object 15 at a desired position and orientation. The bow counterweight 16 is then slid into the bow counterweight support 24, thereby holding the bow 12 from the desired surface 14.

The archery bow counterweight support or holder 24 has a generally tubular, and preferably cylindrical, body which has an internal cavity or bore 28 extending centrally and longitudinally through the counterweight support 24. The bore 28 is preferably a through-bore extending over the full length of holder 24, so that the holder 24 is open at both ends. The bore 28 is shaped to receive the bow counterweight 16. A connecting element 26 includes a shaft 29 having one end 30 rigidly connected to an outer surface 32 and preferably at an approximate longitudinal midpoint of the counterweight support 24. The shaft 29 of the connecting element 26 lateral extends outwardly preferably in a direction generally perpendicular to the longitudinal centerline 36 of the counterweight support 24. The opposite end 34 of the connecting element 26 preferably has a taper 38 extending from a distal end of the shaft 29. The taper 38 has screw threads or other helical surfaces 40 which facilitate penetration of the connecting element 26 through the desired surface 14 and into the object 15

In use the archer manually grips the generally T-shaped bow holder 10 and positions the end 34 of the connecting element 26 at a desired location against the surface 14. The archer then applies a force directed along the centerline 42 of the connecting element 26 toward the desired surface 14. While applying that force, the archer rotates the archery bow holder 10 in a rotational direction, for example, a clockwise direction, which causes the threads 40 to engage the object 15; the bow holder 10 is screwed into the object 15.

Figure 3:
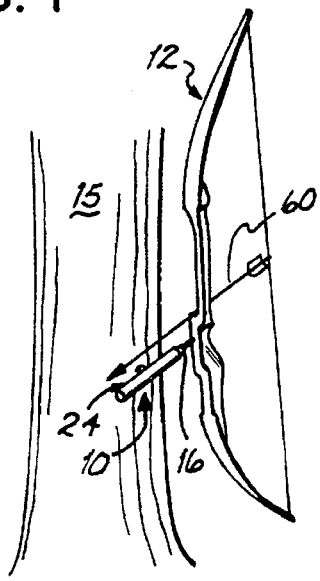
FIG. 3 is a perspective view of the bow holder holding a bow and arrow in a tree.

The archery bow holder 10 is rotated a number of times such that it can withstand a force in the generally vertically downward direction which is at least equal to the weight of the archery bow 12. The archery bow holder 10 is further rotated such that the end 46 of the counterweight support 24 through which the counterweight is to be inserted is generally at the vertical height at least equal to and preferably greater than the vertical height of the other end 48 of the counterweight support 24. Next, the archery bow counterweight 16 is slid or inserted into the longitudinal bore 28 of the counterweight support 24. Therefore, as shown in FIG. 3, the archery bow 12 is maintained in any desired position and orientation as determined by the archer. Further, when supported by the bow counterweight, an arrow 60 can be loaded in the bow so that it is ready for immediate use. Most arrows include ends which frictionally engage the string to keep the arrow 60 in a ready position. The present invention permits a hunter to take advantage of this feature by supporting the counterweight at an oblique downward angle which permits the arrow to rest on the bow shaft. In addition, because of the small size of the bow holder and because there are no limitations on the position or orientation in which the bow is supported, the bow can be supported at an orientation that permits the hunter to grab the bow and move it to a shooting position with a simple and continuous motion that blends and is compatible with the firing motions practiced by the hunter. Consequently, with the counterweight support, the archery bow may be quickly removed from the archery bow holder 10 and fired without interference therefrom. Also, the bow holder of the present invention is lightweight and easy to carry and pack with other equipment.

Figure 2:
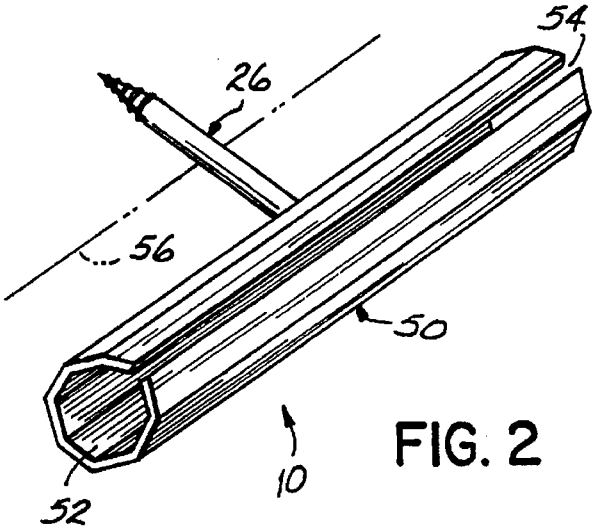
FIG. 2 is a perspective view of an alternative embodiment of the archery bow holder.

While the invention has been set forth by a description of the embodiment in considerable detail, it is not intended to restrict or in any way limit the claims to such detail. Additional advantages and modifications will readily appear to those who are skilled in the art. For example, while the counterweight support 24 is illustrated as a hollow or tubular cylinder open at both ends, the counterweight support 24 may be closed at one end, for example, the end 48. Alternatively, referring to FIG. 2 the archery bow holder 10 may be comprised of a multilateral counterweight support 50 which has any number of sides. Further, the counterweight support may be constructed such that its outer surface does not completely extend around and fully enclose the internal longitudinal bore 52. With that construction the counterweight support contains a peripheral opening 54 that extends longitudinally the entire length of the counterweight support 50. With such an embodiment, the counterweight support is preferably made from a malleable material, for example, aluminum, brass or copper, and the archer can manually increase or decrease the opening 54 by moving the edges 62, 64 apart or together, respective, thereby enlarging or reducing the size of the internal cavity 52 to accommodate different sizes of the archery bow counterweight 16. Also illustrated in FIG. 2 the archery bow holder 10 can be connected to a surface regardless of its orientation as illustrated by the oblique surface 56.

Figure 4:
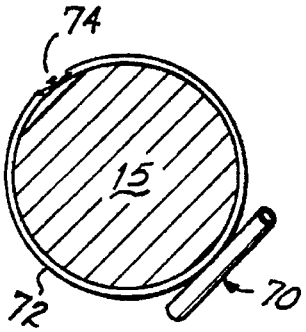
FIG. 4 illustrates an alternative embodiment of the present invention.

Further, as shown in FIG. 4, the tubular bow counterweight holder 70 is connected to the object 15 by a flexible strap 72 such as a nylon strap which can be wrapped around the object 15 which may be a tree trunk, tree limb or post to form a closed loop configuration around the object 15. The flexible strap 72 is connected to the holder 70 to maintain the centerline 36 of the holder 70 both substantially tangential to an outer perimeter of the closed loop configuration of the holder 70 and substantially perpendicular to a radial direction of the closed loop configuration. The ends of the strap 72 are joined together by a buckle, S -hooks, velcro pads or other connector 74. Alternatively, the flexible strap may be a rubber strap, for example, a bunji cord, the ends of which are stretched around the object 15 and connected by S-hooks.

In any event, all of the above embodiments support a bow from a tree, post or other object by simply slipping the bow counterweight into a bow counterweight support. The bow counterweight support can be modified in its structure as long as it is effective to support the weight of the archery bow and preferably an arrow in a desired position and orientation selected by the hunter. Departures may be made from the details described herein without departing from the spirit and scope of the invention.

What is claimed is:

1. An archery bow holder comprising:

an archery bow having a bow counterweight extending in a generally forward direction from the archery bow;

a generally tubular support having a generally longitudinal bore with an opening at one end shaped to receive the bow counterweight; and a connecting element rigidly connected to an outer lateral surface of the support and adapted to mount the archery bow holder to a tree, thereby supporting the bow counterweight support and the archery bow from the tree.

2. An archery bow holder for supporting an archery bow from a tree comprising:

a bow counterweight adapted to be connected to the archery bow;

a bow counterweight support having a generally longitudinal bore with an opening at one end shaped to receive the bow counterweight; and a screw connector having one end connected to an outer lateral surface of the counterweight support, and an opposite end adapted to penetrate a surface on the tree in response to rotation of the screw connector, thereby supporting the bow counterweight support and the archery bow from the tree.

3. An archery bow holder for holding a counterweight of an archery bow to hang the archery bow from an elevated surface, the archery bow holder comprising:

a generally tubular support having an internal cavity with a shape adapted to receive the counterweight of the archery bow; and a connecting element having one end rigidly connected to an outer lateral surface of the support and having an opposite end extending in a generally perpendicular direction outwardly from the outer lateral surface, the connecting element having a threaded taper on the opposite end adapted to mount the support on the elevated surface.

4. The archery bow holder of claim 3 wherein the internal cavity is generally cylindrical.

5. The archery bow holder of claim 3 wherein the internal cavity extends through a full length of the support, the internal cavity having a shape adapted to receive the counterweight of the archery bow at either end of the support.

6. The archery bow holder of claim 3 wherein the one end of the connecting element is rigidly connected to the outer lateral surface of the support at substantially a longitudinal midpoint of the support.

7. The archery bow holder of claim 3 wherein the internal cavity is multilateral.

8. The archery bow holder of claim 3 wherein the tubular support has a longitudinal opening extending a full length of the support to produce two opposed longitudinal edges, whereby the longitudinal edges may be selectively spread apart and brought together to make the support larger and smaller, respectively.

9. An archery bow holder for holding a counterweight of an archery bow to hang the archery bow from an elevated surface, the archery bow holder comprising:

a generally tubular support having an internal cavity with a shape adapted to receive the counterweight of the archery bow; and a connecting element having one end rigidly connected to an outer lateral surface of the support substantially at a longitudinal midpoint of the support and having an opposite end extending outwardly from the outer lateral surface, the connecting element having a threaded taper on an opposite end adapted to mount the support on the elevated surface.

10. The archery bow holder of claim 9 wherein the opposite end of the connecting element extends in a generally perpendicular direction away from the outer lateral surface of the support.

11. An archery bow holder for holding a counterweight of an archery bow to hang the archery bow from an object, the archery bow holder comprising:

a generally tubular support having a longitudinal centerline and an internal cavity with a shape adapted to receive the counterweight of the archery bow; and a flexible connecting element connected to an outer lateral surface of the support at a point intermediate ends of the connecting element, the ends of the connecting element having respective interlocking elements, and the ends of the connecting element being adapted to extend around the object to permit the interlocking elements to be interlocked and form a closed loop around the object, the flexible connecting element being connected to the support to hold the support in an orientation such that the centerline is substantially tangent to a perimeter of the closed loop, thereby permitting the tubular support to receive the counterweight and to hang the archery bow from the object.

12. A method of hanging an archery bow having a bow counterweight from a desired elevated surface comprising the steps of:

positioning one end of a screw connector rigidly connected to an outer lateral surface of a bow counterweight support against the desired elevated surface, the bow counterweight support having a longitudinal bore with an opening at one end adapted to receive the bow counterweight;

applying a force to the screw connector in a direction generally toward the desired surface;

rotating the screw connector and the bow counterweight holder simultaneously with applying the force to the screw connector to cause the screw connector to penetrate the desired surface;

rotating the screw connector and the bow counterweight support to orient the opening of the longitudinal bore of the counterweight support at a vertical height at least equal to a vertical height of an opposite end of the longitudinal bore; and inserting the bow counterweight through the opening and into the longitudinal bore of the bow counterweight support to hang the archery bow from the desired elevated surface.

* * * * *

UNITED STATES PATENT AND TRADEMARK OFFICE

CERTIFICATE OF CORRECTION

PATENT NO. : 5,630,568
DATED : May 20, 1997
INVENTOR(S) : Edward Lubrecht

It is certified that error appears in the above-indentified patent and that said Letters Patent is hereby corrected as shown below:

In column 2, line 62, in the Detailed Description of the Invention, after "outer" insert --lateral-- as shown in the In column 2, line 65, in the Detailed Description of the Invention, delet "lateral"

In column 3, line 63, in the Detailed Description of the Invention, after "50" insert --to form two opposed longitudinal edges 62, 64--

In column 3, line 67, in the Detailed Description of the Invention, delete "respective" and insert --respectively--

Signed and Sealed this

Twenty-first Day of July, 1998

Bruce Lehman

*Attest:*

BRUCE LEHMAN

*Attesting Officer*

*Commissioner of Patents and Trademarks*